United States Patent [19]

Mintz

[11] Patent Number: 4,720,983

[45] Date of Patent: Jan. 26, 1988

[54] HEATER/COOLER UNIT

[75] Inventor: Alvin Mintz, Pepper Pike, Ohio

[73] Assignee: Shaker Tinning & Heating Co., Cleveland, Ohio

[21] Appl. No.: 931,137

[22] Filed: Nov. 17, 1986

[51] Int. Cl.[4] ..... F25D 23/12

[52] U.S. Cl. ..... 62/259.1; 62/263; 62/228.1; 62/525

[58] Field of Search ..... 62/160, 226, 203, 216, 62/263, 442, 117, 525, 324.1, 228.1, 228.4, 228.5, 259.1; 165/50, 58; 98/39.1

[56] References Cited

U.S. PATENT DOCUMENTS

| | | | |
|---|---|---|---|
| 2,590,741 | 3/1952 | Watkins | 62/203 X |
| 2,975,609 | 3/1956 | Allander et al. . | |
| 3,128,610 | 4/1964 | Moore | 62/263 |
| 4,124,998 | 11/1978 | Swiderski | 62/442 |
| 4,179,894 | 12/1979 | Hughes | 62/235.1 |
| 4,201,065 | 5/1980 | Griffin | 62/510 |
| 4,268,621 | 1/1983 | Yamaguma et al. | 62/117 |
| 4,462,460 | 7/1984 | Brauer | 62/160 |
| 4,530,395 | 10/1985 | Parker et al. | 165/2 |
| 4,549,601 | 10/1985 | Wellman et al. | 98/39.1 X |
| 4,643,002 | 2/1987 | Dennis et al. | 62/117 X |
| 4,644,759 | 2/1987 | Bingham | 62/263 X |

OTHER PUBLICATIONS

"Zoneline Heat Pumps and Air Conditioners", GE brochure, Nov., 1985.

"Ductless Air Conditioners & Heat Pumps", Sanyo Brochure, date unknown.

"Incremental Comfort Conditioner", McQuay Brochure, 1985.

*Primary Examiner*—Lloyd L. King

*Attorney, Agent, or Firm*—Wayne D. Porter, Jr.

[57] ABSTRACT

A heater/cooler unit specially adapted for motels, hotels, hospitals and like structures enables adjacent rooms to be cooled or heated by using certain commonly shared components. An evaporator is disposed in each of two adjacent rooms. The evaporators are connected to a common compressor and condenser disposed outside the rooms. Appropriate control mechanisms are provided to enable the evaporators to operate independently. The components are disposed in a housing which forms a portion of the exterior wall of the structure and a portion of the common wall of the rooms. Electrical strip heaters can be added to the evaporators to provide a heating capability. An alternative embodiment employs interior and exterior heat exchangers operated as heat pumps.

18 Claims, 5 Drawing Figures

HEATER/COOLER UNIT

BACKGROUND OF THE INVENTION

1. Field of the Invention

The invention relates to heating and cooling devices and, more particularly, to apparatus suitable for cooling and heating adjacent rooms in such structures as hotels, motels, hospitals, and the like.

2. Description of the Prior Art

In many buildings such as apartments, hotels, motels, hospitals, office buildings, and so forth, it is desirable to provide separate heating and cooling systems for individual rooms. A variety of units presently are commercially available that can be installed in each room, usually on an exterior wall, to provide cooling only, cooling plus heating with electric heat, or cooling plus heating with a heat pump. Typical commercially available heating/cooling units are marketed by the General Electric Company, Louisville, Ky. 40225, under the trademark ZONELINE.

Although commercially available heater/cooler units such as the ZONELINE unit function adequately, a problem not addressed by these units is the expense associated with providing heating and cooling capabilities for individual rooms. Current practice with heater/-cooler units is to install one unit in each room having an exterior wall. By definition, such an arrangement requires that various components of these units such as compressors and condensers be provided for each room. Desirably, a heater/cooler unit would provide only such components in each room as are needed to carry out the heating or cooling requirements for that room, with the remainder of the components being shared among rooms as much as possible.

Various techniques are known for heating or cooling different zones by means of heating or cooling apparatus located at a remote location. See, for example, U.S. Pat. Nos. 4,124,998; 4,368,621; 4,530,395; and 4,549,601. These prior art techniques have certain drawbacks such as undue expense, complexity, and difficulty of operation that limit their effectiveness in heating or cooling individual rooms in buildings such as hotels, motels, and the like.

SUMMARY OF THE INVENTION

The present invention addresses the foregoing and other problems of the prior art and provides a new and improved heating and cooling unit. The invention provides a method and apparatus for cooling and heating two or more adjacent rooms from the same unit without a mixing of the air between the rooms and with individual control of cooling and heating using a common condenser or heat exchanger. In its most basic form, the present invention provides only a cooling capability. The apparatus employs a first evaporator in one room, a second evaporator in an adjacent room, a condenser in fluid communication with both the first and second evaporators, a compressor in fluid communication with the condenser and with a return side of the first and second evaporators, and a control means for controlling fluid flow through each evaporator, the control means permitting fluid flow through the first evaporator to be controlled independently of fluid flow through the second evaporator.

In the preferred embodiment, the foregoing components are disposed within a housing which forms a portion of the exterior wall of the structure and a portion of the common interior wall of the rooms. By this arrangement, only one opening in the exterior wall is needed to permit cooling of two rooms while, at the same time, the cooling requirements for the two rooms can be determined independently by the occupants of the rooms. Use of the invention cuts in half a large number of the components commonly used with cooling units, and it also cuts in half the number of exterior openings required to be made in the walls of the building. As a consequence, significant cost savings can be realized, particularly in the case of buildings such as hotels and apartment buildings having many rooms.

If desired, a heating capability can be included by the addition of electric strip heaters or other known types of heaters disposed adjacent each of the evaporators. Heating also can be provided by operating the unit as a heat pump. In this embodiment of the invention, the evaporators and the condenser are operated as heat exchangers with a separate condenser/heat exchanger being provided for each of the evaporator/heat exchangers. Each heat exchanger pair is provided with its own compressor, thermostatically controlled changeover valve, and parallel connecting conduits such that the heat exchanger disposed in each room can be operated either in an air conditioning mode or in a heating mode. Savings can be realized by disposing all of the components in a common housing, as well as by disposing the two condenser/heat exchangers adjacent each other and cooling them with a common fan or a common source of water.

The foregoing features and advantages, as well as a more complete understanding of the invention, can be had by reviewing the accompanying specification and claims, together with the drawings.

DESCRIPTION OF THE PREFERRED EMBODIMENT

Figure 1:
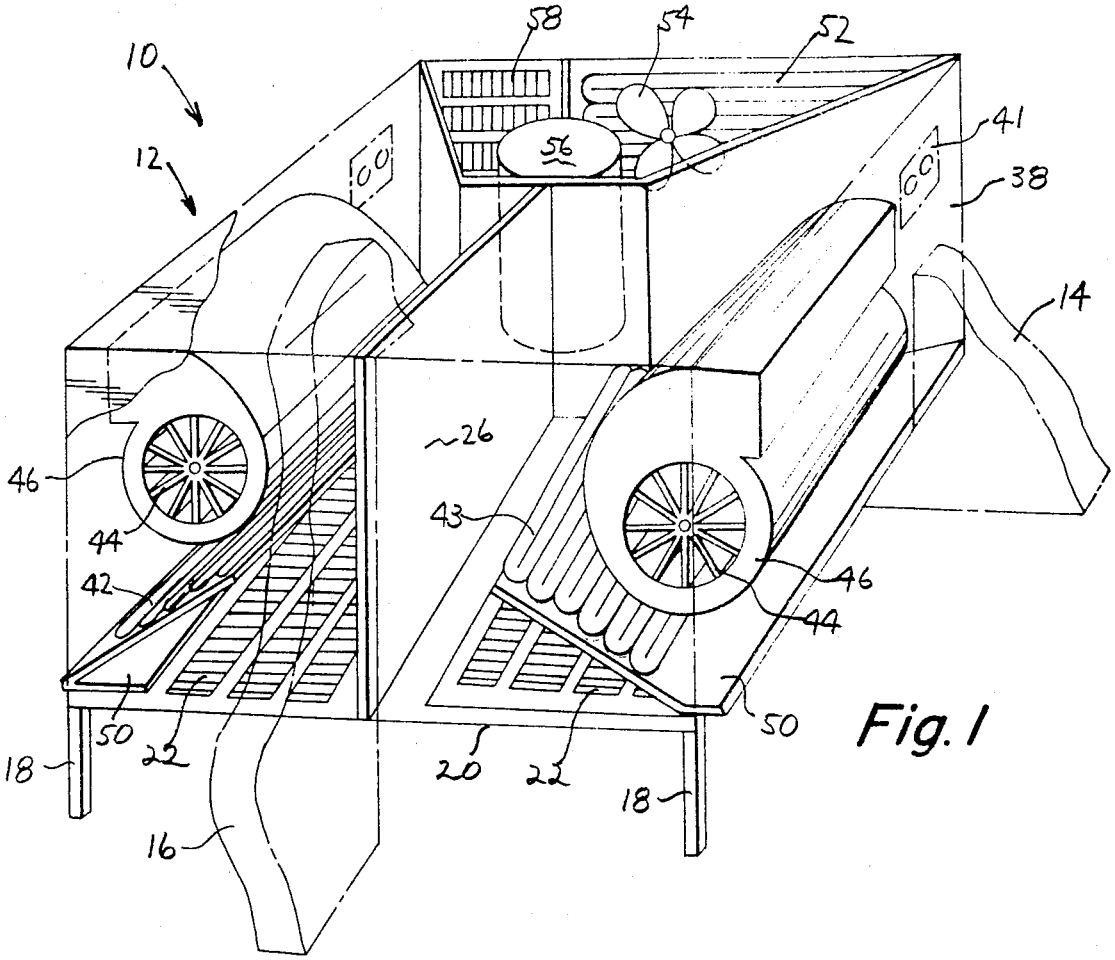
FIG. 1 is a perspective, schematic view of a heater/-cooler unit according to the invention as it might be installed in a hotel, motel, or like structure.
Figure 2:
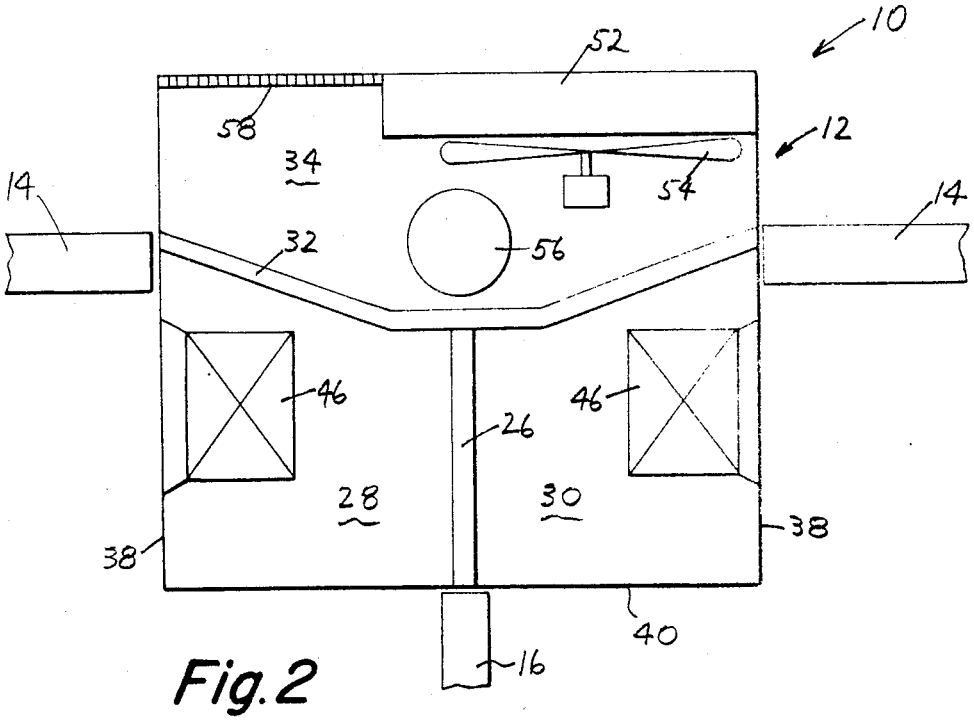
FIG. 2 is a schematic plan view of the unit of FIG. 1.
Figure 3:
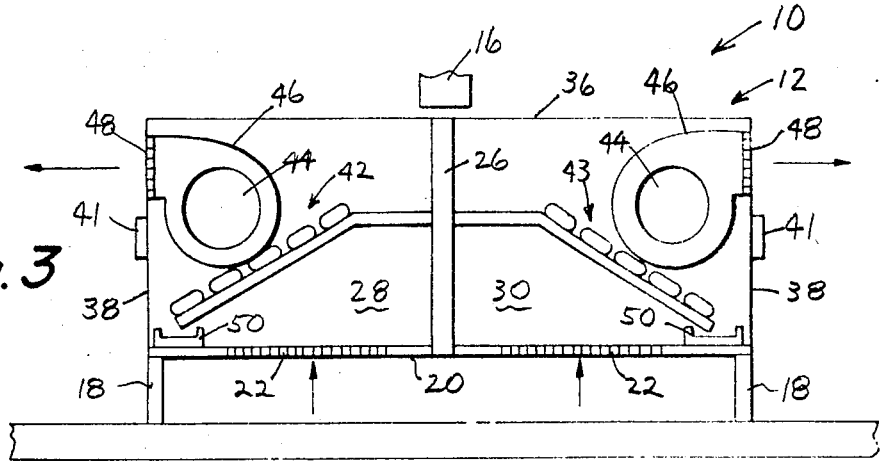
FIG. 3 is a schematic end view of the unit of FIG. 1.

Referring particularly to FIGS. 1–3, air conditioning apparatus is indicated generally by the reference numeral 10. As used herein, such terms as "unit," "air conditioning apparatus," "heater/cooler unit," and so forth are used interchangeably for purposes of convenience. It will be understood that the cooling and heating characteristics of a device produced according to the invention will depend upon the features selected by the purchaser.

The unit 10 includes a cubic housing 12 within which the various components of the invention are disposed. The housing 12 extends through an opening formed in an exterior wall 14 of the building, and the housing 12 straddles an opening formed in a common interior wall 16 dividing two adjacent rooms. The housing 12 is provided with legs 18 that both support the housing 12 and space the bottom 20 of the housing 12 above the floor such that air can freely enter the housing 12 through louvered openings 22.

The housing 12 includes a vertically extending interior wall 26 which divides the housing into compartments 28, 30. The compartment 28 is disposed in one room, while the compartment 30 is disposed in the other room. The housing 12 also includes a vertical, laterally extending interior wall 32 which defines a third compartment 34. The wall 32 is positioned relative to the exterior wall 14 such that the compartment 34 extends outside of the building or at least is exposed to the atmosphere outside the building. The interior portions of the housing 12 include a smooth upper surface 36, sidewalls 38, and end walls 40. Control panels 41 are disposed on the sidewalls 38, one control panel 41 being provided for each room. The size and shape of the components defining the housing 12 enable the housing 12 to be utilized as a desk or as a support for such items as lamps, televisions, radios, books, and the like.

A first evaporator 42 is disposed in the compartment 28 and a second evaporator 43 is disposed in the compartment 30. A fan 44 is disposed adjacent each of the evaporators 42, 43. Each fan 44 is disposed within a housing 46 discharging through louvered openings 48 in each of the walls 38. Drip pans 50 are disposed beneath the evaporators 42, 43 to collect condensate when the evaporators 42, 43 are operating in an air conditioning mode. As will be apparent from an examination of FIGS. 1 and 3, upon activation of the fans 44, air will be drawn upwardly through the openings 22 in the bottom wall 20, ducted through the coils of the evaporators 42, 43, and discharged back into the rooms through the openings 48.

A condenser 52, fan 54, compressor 56 are disposed in the compartment 34. Openings 58 in the compartment 34 enable air to be drawn into the compartment 34 where it can be forced under pressure through the coils of the condenser 52 and back into the atmosphere.

Figure 4:
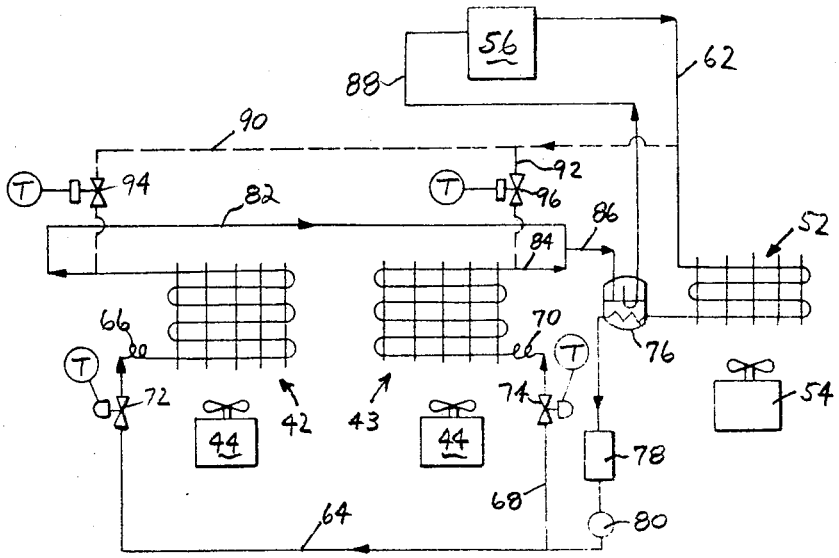
FIG. 4 is a piping diagram for one embodiment of the invention.

Referring now to FIG. 4, the various components illustrated schematically in FIGS. 1–3 are shown connected for purposes of air conditioning. A conduit 62 connects the high pressure side of the compressor 56 with the input side of the condenser 52. A conduit 64 is connected at one end to the output side of the condenser 52 and is connected at its other end to a capillary tube 66 which in turn is connected to the input side of the evaporator 42. A conduit 68 is tapped into the conduit 64 and is connected to another capillary tube 70 which in turn is connected to the input side of the evaporator 43. Thermostatically controlled, solenoid-actuated valves 72, 74 are disposed in the conduits 64, 68 immediately upstream of the capillary tubes 66, 70. The conduit 64 passes in heat exchange relationship through an accumulator 76. A filter/dryer 78 and a sight glass 80 also are disposed in the conduit 64.

Conduits 82, 84 are connected to the output side of the evaporators 42, 43, respectively. A common connecting conduit 86 establishes fluid communication between the conduits 82, 84 and the accumulator 76. A conduit 88 connects the accumulator 76 with the suction side of the compressor 56.

As will be apparent from an examination of FIG. 4, upon activation of the compressor 56, high pressure, high temperature fluid will be forced through the condenser 52 where it will be cooled by means of the fan 54. After passing through the accumulator 76, the filter/dryer 78, and the sight glass 80, and upon appropriate activation of either or both of the valves 72, 74, the fluid will be passed through the capillary tubes 66, 70 and then through the evaporators 42, 43. Air passing through the evaporators 42, 43 by virtue of activation of the fans 44 will be cooled, thereby cooling the room in which each of the evaporators 42 is disposed. After passing through the evaporators 42, 43, the fluid will be conveyed through the accumulator 76 where it will be returned to the compressor 56.

If the compressor 56 has two speeds, then the lower speed can be employed when only one of the evaporators 42, 43 is in use. If both of the evaporators 42, 43 are in use, then the higher speed of the compressor 56 can be utilized. If, however, a single-speed compressor is utilized, then a hot gas bypass must be provided for those instances where only one of the evaporators 42, 43 is being used. Such a bypass arrangement is indicated in FIG. 4 by the dotted lines 90, 92 which illustrate, respectively, a conduit connected between the conduit 62 and the conduit 82, and a conduit connected between the conduit 90 and the conduit 84. Thermostatically controlled bypass valves 94, 96 are disposed in the conduits 90, 92, respectively.

As will be apparent from an examination of FIG. 4, whenever predetermined temperature and/or pressure limits in the compressor 56 are exceeded, hot gas will be bypassed from the high pressure side of the condensor 52 to the return side of the evaporators 42, 43. The valves 94, 96 will be activated as appropriate to control the flow of hot fluid to the return side of the evaporator 42 or 43 being used.

The arrangement illustrated schematically in FIG. 4 provides an air conditioning capability only. If desired, electric strip heaters can be added to the evaporators 42, 43 to provide a heating capability. Additionally, if desired, the condenser 52 can be water cooled rather than air cooled. If a water cooling arrangement is provided, the fan 54 will be eliminated, but no other changes need to be made to the components of the system.

Figure 5:
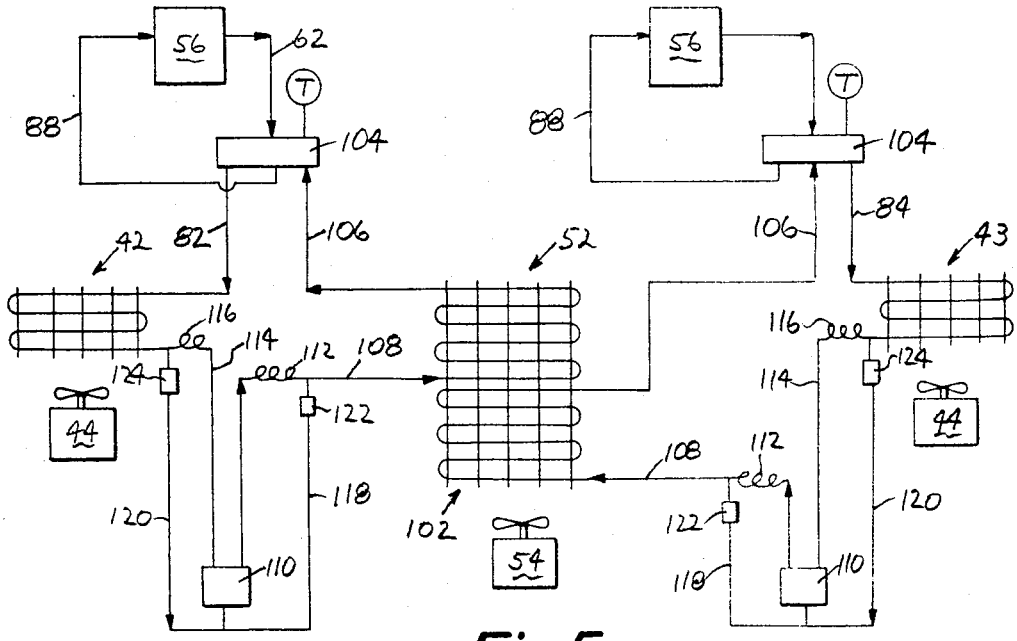
FIG. 5 is a piping diagram for an alternative embodiment of the invention.

Referring now to FIG. 5, an alternative embodiment of the invention is illustrated wherein both a heating and a cooling capability is provided by air conditioning apparatus operated as a heat pump. Where appropriate, reference numerals from the first-described embodiment will be used in the description of the alternative embodiment. As in the first embodiment, the evaporators 42, 43 and associated fans 44 are disposed in each of the rooms while the condenser 52 and its associated fan 54 are disposed outside of the rooms. Unlike the first-described embodiment, however, the alternative embodiment provides for fluid flow to be reversed through the evaporators 42, 43 depending upon whether the unit is in a cooling mode or a heating mode. Accordingly, the evaporators 42, 43 and condenser 52 will be referred to as "heat exchangers." An additional heat exchanger 102 also is provided, the additional heat exchanger 102 being disposed adjacent the heat exchanger 52 such that it can be cooled by the fan 54.

Each of the heating and cooling circuits is provided with a thermostatically controlled, solenoid-actuated changeover valve 104. The conduit 62 is connected to the input side of the valve 104. A conduit 106 connects each of the valves 104 to the heat exchangers 52, 102. The conduit 88 also is connected to the changeover valve 104 while the conduits 82, 84 are connected to the heat exchangers 42. The first and third heat exchangers 42, 52 are connected to each other by a parallel connection 107, as are the second and fourth heat exchangers 43, 102. The parallel connection 107 for the heat exchangers 42, 52 is provided by a conduit 108 which is connected at one end to the heat exchanger 52 and is connected at its other end to a filter/dryer 110. A capillary tube 112 is disposed in the conduit 108. Another conduit 114 is connected at one end to the heat exchanger 42 and is connected at the other end to the filter/dryer 110. Another capillary tube 116 is disposed in the conduit 114. A conduit 118 connects the filter/dryer 110 to the conduit 108 across the capillary tube 112. Similarly, a conduit 120 connects the filter/dryer 110 to the conduit 114 across the capillary tube 116. A check valve 122 is disposed in the conduit 118, while a check valve 124 is disposed in the conduit 120. The reference numerals for the parallel connection 107 are used for the same components that interconnect the heat exchangers 43, 102.

As will be apparent from an examination of FIG. 5, the apparatus is in a heat, pump-type heating mode when the changeover valves 104 are in the position illustrated. High temperature, high pressure fluid will be directed through the conduits 82, 84 into the heat exchangers 42, 43 where it will release heat into the rooms. The fluid will pass through the check valves 124 and the conduits 120, through the filter/dryers 110, through the capillary tubes 112, the conduits 108, and into the heat exchangers 52, 102. Activation of the fan 54 will cause relatively warm atmosphere air to be directed over the heat exchangers 52, 102. Fluid thus heated will be drawn through the conduits 106, the valves 104, and the conduits 88 back into the suction side of the compressors 56.

Upon activation of the changeover valve 104, the flow of fluid through the components will be reversed and the apparatus will be in an air conditioning mode. Fluid now will be directed through the check valves 122, the conduits 118, the filter/dryers 110, the conduits 114, and the capillary tubes 116. It will be apparent that each of the valves 104 can be operated independently of the other so as to provide individual control of heating or air conditioning for each of the rooms being serviced.

As in the first-described embodiment, the heat exchangers 52, 102 can be water cooled, if desired. Additionally, because the two heat exchangers 52, 102 are disposed adjacent each other, it is desirable to provide either a pressure-controlled variable speed fan 54 or a preprogrammed two-speed fan 54. The lower speed can be selected when only one of the heat exchangers 52, 102 is in operation, while the higher speed can be selected when both of the heat exchangers 52, 102 are in operation.

Although the invention has been described in its preferred form with a certain degree of particularity, it will be apparent that various changes and modifications can be made without departing from the true spirit and scope of the invention as hereinafter claimed. It is expected that the patent cover all such changes and modifications. It also is intended that the patent shall cover, by suitable expression in the appended claims, whatever features of patentable novelty exist in the invention disclosed.

What is claimed is:

1. Air conditioning apparatus especially adapted for cooling adjacent rooms in a motel, hotel, hospital or like structure, comprising:

a first evaporator disposed in one room;

a second evaporator disposed in an adjacent room;

a condenser disposed outside the rooms but in fluid communication with both the first and second evaporators;

a compressor disposed outside the rooms but in fluid communication with the condenser and with a return side of the first and second evaporators;

control means for controlling the fluid flow through each evaporator, the control means permitting fluid flow through the first evaporator to be controlled independently of fluid flow through the second evaporator; and a housing exposed to the atmosphere through the exterior wall of the structure and forming a portion of the common interior wall of the rooms, the evaporators, condenser, compressor, and control means being disposed within the housing.

2. The apparatus of claim 1, wherein the compressor operates at a first speed when one of the evaporators is being utilized, and operates at a second speed when both of the evaporators are being utilized.

3. The apparatus of claim 1, wherein the compressor operates at a single speed and a high pressure bypass line is connected intermediate the compressor and the condenser and the return side of each of the evaporators.

4. The apparatus of claim 1, wherein the control means includes a thermostatically controlled, solenoid-actuated valve upstream of each evaporator, the thermostat for the first valve being located in the first room, and the thermostat for the second valve being located in the second room.

5. The apparatus of claim 1, further comprising electric strip heaters disposed adjacent each of the evaporators.

6. The apparatus of claim 1, wherein the condensor is water cooled.

7. The apparatus of claim 1, wherein the housing includes a vertically extending interior wall that divides the housing into first and second compartments, the first compartment being disposed in one room and the second compartment being disposed in the adjacent room, the first evaporator being disposed in the first compartment and the second evaporator being disposed in the second compartment.

8. The apparatus of claim 7, wherein the housing further includes a second vertically extending wall that defines a third compartment exposed to the atmosphere, the condenser and the compressor being disposed in the third compartment.

9. The apparatus of claim 7, wherein the first and second compartments include openings establishing fluid communication between the compartments and the rooms within which the compartments are disposed.

10. The apparatus of claim 1, wherein the housing forms a portion of the exterior wall of the structure.

11. Air conditioning and heating apparatus especially adapted for cooling and heating adjacent rooms in a motel, hotel, hospital or like structure, comprising:

a first heat exchanger disposed in one room;

a second heat exchanger disposed in an adjacent room;

a third heat exchanger in fluid communication with the first heat exchanger, the third heat exchanger being disposed outside the structure;

a fourth heat exchanger in fluid communication with the second heat exchanger, the fourth heat exchanger being disposed outside the structure;

a first compressor disposed outside the structure but in fluid communication with the first and third heat exchangers;

a second compressor disposed outside the structure but in fluid communication with the second and fourth heat exchangers;

a first control valve for directing high pressure, high temperature fluid to either the first or third heat exchanger; and a second control valve for directing high pressure, high temperature fluid to either the second or fourth heat exchanger.

12. The apparatus of claim 11, wherein the first and second control valves are in the form of thermostatically controlled, solenoid-actuated valves.

13. The apparatus of claim 11, wherein the heat exchangers, compressors, and control valves are disposed within a housing, the housing forming a portion of the exterior wall of the structure and a portion of the common interior wall of the rooms.

14. The apparatus of claim 11, wherein the third and fourth heat exchangers are water cooled.

15. The apparatus of claim 11, wherein the third and fourth heat exchangers are disposed adjacent each other.

16. The apparatus of claim 11, wherein the third and fourth heat exchangers are air cooled by means of a fan, the fan having a two-speed motor, the fan being operated at one speed when either the first or second heat exchanger is being operated in a cooling mode, the fan being operated at a higher speed when both the first and second heat exchangers are being operated in a cooling mode.

17. The apparatus of claim 11, wherein the first and third heat exchangers are connected to each other in fluid communication by means of parallel conduits, each of the conduits having a check valve such that fluid flowing from the first heat exchanger to the third heat exchanger flows through one of the conduits, while fluid flowing from the third heat exchanger to the first heat exchanger flows through the other conduit.

18. The apparatus of claim 17, wherein the second and fourth heat exchangers are connected in fluid communication with each other by means of parallel conduits, each of the conduits containing a check valve such that fluid flowing from the second heat exchanger to the fourth heat exchanger flows through one of the conduits, while fluid flowing from the fourth heat exchanger to the second heat exchanger flows through the other conduit.

* * * * *